US007318382B2

(12) United States Patent
Kaneko

(10) Patent No.: US 7,318,382 B2
(45) Date of Patent: Jan. 15, 2008

(54) METHOD FOR INCINERATION DISPOSAL OF WASTE

(75) Inventor: Masamoto Kaneko, Takasaki (JP)

(73) Assignee: Kinsei Sangyo Co., Ltd., Gunma (JP)

( * ) Notice: Subject to any disclaimer, the term of this patent is extended or adjusted under 35 U.S.C. 154(b) by 824 days.

(21) Appl. No.: 10/344,242

(22) PCT Filed: Jun. 7, 2001

(86) PCT No.: PCT/JP01/04810

§ 371 (c)(1),
(2), (4) Date: Aug. 1, 2003

(87) PCT Pub. No.: WO02/14743

PCT Pub. Date: Feb. 21, 2002

(65) Prior Publication Data

US 2004/0025763 A1 Feb. 12, 2004

(30) Foreign Application Priority Data

Aug. 11, 2000 (JP) ..... 2000-244170

(51) Int. Cl.
*F23G 5/02* (2006.01)

(52) U.S. Cl. ..... 110/346; 110/342; 110/345

(58) Field of Classification Search ..... 110/342, 110/344, 345, 346

See application file for complete search history.

(56) References Cited

U.S. PATENT DOCUMENTS 4,430,094 A * 2/1984 Gorzegno ..... 48/76
5,052,312 A * 10/1991 Rackley et al. ..... 110/346

(Continued)

FOREIGN PATENT DOCUMENTS

JP 57-114228 7/1982

(Continued)

OTHER PUBLICATIONS

Note: An abstract of JP 2-135280 is attached to serve as a partial translation thereof. Relevance of the reference is also discussed in the present specification.

*Primary Examiner*—Kenneth Rinehart
(74) *Attorney, Agent, or Firm*—Paul A. Guss

(57) ABSTRACT

There is provided a method of incinerating a waste material to process incineration residues produced in a gasification furnace easily with existing equipment. A combustible gas generated when a waste material A is dry-distilled in a gasification furnace 1 is introduced into a combustion furnace 3 and combusted therein. The combustible gas is generated in the gasification furnace 1 in order to keep the temperature in the combustion furnace 3 at a temperature capable of melting incineration residues. The incineration residues are charged into the combustion furnace 3 while the combustible gas is being combusted therein, and melted into a melted material B that is discharged from an outlet 3 of the combustion furnace 3 into a receptacle 33 in which the melted material B is solidified. Air supplied to an air jacket 6 and oxygen supplied to the gasification furnace 1 and the combustion furnace 3 are heated by a heat exchange with waste gases from the combustion furnace 3. The heat exchange is carried out by providing a heat exchanger 36 with a conduit 8 disposed therein in a passage of the waste gases from the combustion furnace 4, and passing air or oxygen through the conduit 8 upstream in the passage of the waste gases.

5 Claims, 4 Drawing Sheets

U.S. PATENT DOCUMENTS

| | | | | |
|---|---|---|---|---|
| 5,445,087 | A | 8/1995 | Kaneko et al. | |
| 5,619,938 | A | 4/1997 | Kaneko et al. | |
| 5,653,180 | A * | 8/1997 | Kaneko | 110/190 |
| 5,858,033 | A * | 1/1999 | Hirayama et al. | 48/198.6 |

FOREIGN PATENT DOCUMENTS

| | | |
|---|---|---|
| JP | 2-135280 | 5/1990 |
| JP | 4-302909 | 10/1992 |
| JP | 8-278014 | 10/1996 |
| JP | 10-232007 | 9/1998 |
| JP | 10-235319 | 9/1998 |
| JP | 11-304129 | 11/1999 |
| WO | WO 00/12938 | 3/2000 |

* cited by examiner

FUEL SUPPLY DEVICE
INCINERATION RESIDUES
CONTROLLER

METHOD FOR INCINERATION DISPOSAL OF WASTE

TECHNICAL FIELD

The present invention relates to a method of incinerating waste materials.

BACKGROUND ART

The applicant of the present application has proposed an apparatus for incinerating waste materials such as waste tires as disclosed in Japanese Laid-Open Patent Publication No. 2-135280. With the disclosed apparatus, a waste material is placed in a gasification furnace having a water jacket for preventing overheating, and a portion of the waste material is burned while the remainder of the waste material is subjected to dry distillation with the heat of combustion. A combustible gas produced by the gasification furnace is introduced into a combustion furnace outside the gasification furnace, in which the combustible gas is burned. The temperature in the combustion furnace is detected and the amount of oxygen supplied to the gasification furnace (specifically, oxygen required for partial combustion of the waste material) is adjusted depending on a change in the detected temperature, for thereby maintaining the temperature in the combustion furnace substantially at a predetermined temperature level. The predetermined temperature level is a temperature for causing the combustible gas to burn of its own accord, and is about 1000° C., for example. With the disclosed apparatus, the amount of oxygen required to burn the combustible gas in the combustion furnace is adjusted depending the detected temperature in the combustion furnace, so that the amount of oxygen commensurate with the amount of the combustible gas introduced into the combustion furnace is supplied to the combustion furnace to combust the combustible gas well in the combustion furnace.

The apparatus thus arranged is capable of incinerating the waste material while suppressing the emission of harmful gases into the atmosphere. Furthermore, since the combustible gas is combusted in the combustion furnace at a substantially constant temperature while the waste material is being subjected to dry distillation in the gasification furnace, the heat of combustion of the combustible gas can effectively be utilized as a heat source for boiler apparatus, etc.

Incineration residues of waste materials such as municipal waste, sewage sludge, industrial waste, etc., including incineration residues (which are basically ashes, but may include waste not completely ashed) that are left in the gasification furnace after the dry distillation of the waste material in the gasification furnace, need to be disposed of in a certain manner. According to one general process, after incineration residues are taken out of the gasification furnace, they are solidified with concrete, asphalt, etc. and disposed of.

However, objects to be disposed of according to the above process, including combustion wastes, are large in weight and volume and are difficult to handle. Since incineration residues may contain dioxins and heavy metals, they may become a secondary pollution source depending on where they are discarded.

According to another process, incineration residues are charged into a melting furnace which is held at a high temperature (e.g., a high temperature of 1400° C. or higher) and melted therein, and the melted incineration residues are cooled into a solid material.

When incineration residues are thus processed, dioxins contained therein can be decomposed, and the solid material can effectively be used as a material of the aggregate for building and construction use.

According to the above other process, however, because the melting furnace for melting incineration residues and an apparatus for heating the melting furnace are required separately from the gasification furnace and the combustion furnace, the overall equipment of the system for processing waste materials is large in size, and the cost required to introduce and maintain the equipment is high.

DISCLOSURE OF THE INVENTION

The present invention has been made in view of the above background. It is an object of the present invention to provide a method of incinerating a waste material to process incineration residues produced after the dry distillation of a waste material in a gasification furnace is finished, easily with existing small-size equipment.

To achieve the above object, there is provided in accordance with the present invention an improvement in a method of incinerating a waste material, having the steps of combusting a portion of the waste material placed in a gasification furnace having an interior space substantially isolated from an exterior space and subjecting the other portion of the waste material to dry distillation with heat produced by the combustion of the portion of the waste material, and introducing a combustible gas generated by the dry distillation into a combustion furnace disposed outside said gasification furnace and combusting the combustible gas in the combustion furnace, wherein combustive oxygen required to combust the combustible gas introduced into said combustion furnace is supplied depending on the amount of the combustible gas into the combustion furnace to combust the combustible gas, and the amount of combustive oxygen supplied to said gasification furnace is controlled depending on a change in the temperature in the combustion furnace such that the temperature in the combustion furnace is kept at a predetermined temperature, for thereby adjusting the amount of the combustible gas generated by the dry distillation. The method of incinerating a waste material according to the present invention is characterized in that said gasification furnace comprises an air-cooled gasification furnace, and is characterized by the steps of supplying combustive oxygen heated by a heat exchange with waste gases from said combustion furnace, to cool said gasification furnace, performing a heat exchange between the combustive oxygen supplied to cool said gasification furnace and the waste gases from said combustion furnace, and supplying the heated combustive oxygen to said gasification furnace and/or said combustion furnace, said predetermined temperature being set to a temperature at which incineration residues produced when the waste material is incinerated are meltable, charging said incineration residues into the combustion furnace from an incineration residue charging port thereof to melt the incineration residues with the heat generated when the combustible gas is combusted, while the combustible gas is being combusted in said combustion furnace, and discharging a melted material converted from the incineration residues out of the combustion furnace from a melted material outlet thereof and cooling the melted material into a solid material.

With the above arrangement of the invention, since the predetermined temperature in the combustion furnace at the time the combustible gas is combusted therein is set to a temperature at which the incineration residues are meltable, while the combustible gas is being combusted in the combustion furnace, the amount of combustible gas generated in the gasification furnace is adjusted to keep the temperature in the combustion furnace at the temperature at which the incineration residues are meltable.

The temperature at which the incineration residues are meltable is generally 1400° C. or higher. In order to keep the temperature in the combustion furnace at the above temperature, the amount the combustible gas introduced from the gasification furnace into the combustion furnace (specifically, the amount the combustible gas introduced into the combustion furnace per unit time) has to be large. Basically, if the amount of oxygen supplied to the gasification furnace (oxygen required for partial combustion of the waste material in the gasification furnace) is increased to increase the portion of the waste material combusted in the gasification furnace, then a large amount of dry distillation gas can be generated in the gasification furnace and introduced into the combustion furnace. However, if the amount of waste material in the gasification furnace is small, then since the portion of the waste material which can be dry-distilled is reduced in a short period of time, it is difficult to keep the temperature in the combustion furnace at a high level capable of melting a sufficient amount of incineration residues. If the amount of waste material in the gasification furnace is increased, then the gasification furnace has to be large in size.

According to the present invention, said gasification furnace comprises an air-cooled gasification furnace. If the gasification furnace is a conventional water-cooled gasification furnace having a water jacket, then though it is highly effective to prevent overheating, the amount of heat removed by an exterior medium, specifically water flowing through the water jacket, is large, suppressing the dry distillation of the waste material. According to the present invention, the amount of heat removed by an exterior medium is reduced as the gasification furnace comprises an air-cooled gasification furnace.

According to the present invention, in order to prevent the gasification furnace from being overheated, combustive oxygen heated by a heat exchange with waste gases from said combustion furnace is supplied to cool said gasification furnace. With this arrangement, the amount of heat removed by an exterior medium is further reduced.

As a result, much of the heat generated by the partial combustion of the waste material is used for dry distillation of the other portion of the waste material (the portion of the waste material which is not combusted) in the gasification furnace, and the waste material consumed by the partial combustion is reduced whereas the waste material that is dry-distilled is increased. Therefore, it is possible to keep relatively small the total amount of waste material in the gasification furnace and portion thereof which is combusted, and at the same time to generate an amount of combustible gas large enough to increase the temperature in the combustion furnace to a high temperature at which the combustible gas is meltable. It is also possible to generate the large amount of combustible gas continuously for a relatively long period of time. Stated otherwise, it is possible to keep the temperature in the combustion furnace at a high temperature at which the combustible gas is meltable, for a relatively long period of time.

According to the present invention, oxygen heated by a heat exchange with waste gases from said combustion furnace is supplied to said gasification furnace and/or said combustion furnace. With the above arrangement, in the gasification furnace, the portion of the amount of heat generated by the partial combustion of the waste material, which portion is absorbed by the combustive oxygen supplied to the gasification furnace, is reduced. As a result, much of the heat is used for dry distillation of the other portion of the waste material, and the waste material consumed for partial combustion is reduced whereas the waste material which is dry distilled is increased.

In the combustion furnace, the portion of the amount of heat generated by the combustion of the combustible gas, which portion is absorbed by combustive oxygen supplied to the combustion furnace, is reduced. Therefore, the amount of combustible gas required to keep the temperature in the combustion furnace at a high level may be small. As a result, it is possible to keep the temperatube in the combustion furnace at a high temperature at which the incineration residues are meltable for a longer period of time. The gasification furnace may thus be of a relatively small size, and the combustion furnace can smoothly melt a sufficient amount of incineration residues.

The heat exchange makes it unnecessary to use a dedicated heat source for heating the combustive oxygen, and effectively utilizes heat energy generated in the combustion furnace.

According to the present invention, combustive oxygen supplied to cool said gasification furnace is supplied to said gasification furnace and/or said combustion furnace, after having cooled said gasification furnace. With this arrangement, the amount of heat removed by an exterior medium is further reduced, and the heat generated by the gasification furnace and the combustion furnace can be recycled efficiently.

According to the present invention, the combustive oxygen heated by the waste gases from the combustion furnace is supplied to cool the air-cooled gasification furnace, the combustive oxygen heated by the waste gases from the combustion furnace is supplied to both the gasification furnace and the combustion furnace, and the cooling combustive oxygen supplied to the gasification furnace is supplied to said gasification furnace and said combustion furnace, thus making it possible to easily achieve a high temperature at which the incineration residues are meltable in the combustion furnace.

Therefore, when the incineration residues are charged into the combustion furnace from an incineration residue charging port thereof while the combustible gas is being combusted in the combustion furnace, the incineration residues are melted in the combustion furnace with the heat of combustion of the combustible gas. Thus, the combustion furnace for combusting the combustible gas is used as a melting furnace to melt the incineration residues in the combustion furnace.

The temperature at which the incineration residues are meltable is generally 1400° C. or higher. When the incineration residues are melted in the high-temperature environment, even if the incineration residues contain dioxins, the dioxins can be thermally decomposed. If the incineration residues contain a waste material which has not been fully ashed, then the waste material is completely combusted and ashed into inorganic materials such as metals in the combustion furnace, and those inorganic materials are thereafter melted.

According to the present invention, the melted material produced when the incineration residues are melted in the combustion furnace is discharged out of the combustion furnace from a melted material outlet thereof and cooled into a solid material.

The solid material thus produced when the melted material is cooled can be used as a material of the aggregate for building and construction use. Since the solid material is obtained from the melted material converted from the incineration residues, the solid material is not larger or heavier than necessary, and can be handled, e.g., transported, with ease.

The melted material discharged out of the combustion furnace may be cooled with air or water. For increasing the strength and rigidity of the solid material, it is preferable to cool the melted material slowly.

According to the present invention, as described above, inasmuch as the incineration residues are melted in the combustion furnace in which the combustible gas generated in the gasification furnace is combusted and the melted material is discharged out of the combustion furnace and then cooled, no dedicated melting furnace is required for melting the incineration residues, and the incineration residues can easily be processed with a existing small-size facility.

The above incineration residues may be incineration residues produced after the waste material are dry-distilled in the gasification furnace, or may be incineration residues produced when various waste materials such as municipal waste, sewage sludge, industrial waste, etc. are combusted.

According to the present invention, it is preferable to add a fluxing agent to said incineration residues before the incineration residues are charged into said combustion furnace. The added fluxing agent lowers the melting point of the incineration residues to make the incineration residues meltable more easily. As much of the incineration residues is contained in the fluxing agent when the melted material is solidified, heavy metals, etc. contained in the incineration residues are prevented from leaking out.

The melted material outlet is a location held in contact with the ambient air and tends to decrease in temperature. Therefore, while the melted material is flowing out of the combustion furnace through the melted material outlet, the melted material is liable to be partially solidified within the combustion furnace near the melted material outlet.

According to the present invention, therefore, the combustion furnace is heated to keep the temperature near said melted material outlet at said predetermined temperature with a heating means provided on said combustion furnace near said melted material outlet after said combustible gas starts to be combusted in said combustion furnace.

With the combustion furnace thus heated, the incineration residues melted in the combustion furnace can flow out of the combustion furnace while being reliably held in a melted state.

According to the present invention, furthermore, said incineration residues are gradually charged into said combustion furnace after the temperature in said combustion furnace rises to a temperature close to said predetermined temperature after the dry distillation of said waste material is started in said gasification furnace.

Because the incineration residues are slowly charged bit by bit into the combustion furnace, the incineration residues are smoothly melted in the combustion furnace successively in the order charged into the combustion furnace. Consequently, the incineration residues are prevented from being deposed in an insufficiently melted state in the combustion furnace, and hence can reliably be melted in the combustion furnace.

According to the present invention, the method is characterized in that the heat exchange for combustive oxygen for cooling the gasification furnace or combustive oxygen supplied to the gasification furnace and/or the combustion furnace is carried out by providing a heat exchanger with an air conduit or an oxygen conduit disposed therein in a passage of the waste gases from said combustion furnace, and passing air or oxygen through the air conduit or the oxygen conduit upstream in the passage of the waste gases. The flow of the waste gases and the flow of the air or oxygen passing through the air conduit or the oxygen conduit are directed opposite to each other. The air or oxygen is initially heated by a heat exchange with the waste gases at a relatively low temperature, and then further heated by a heat exchange with the waste gases at a relatively high temperature. Thus, an excellent heat exchange efficiency is achieved.

The heat exchange makes it unnecessary to use a dedicated heat source for heating the air or oxygen, and effectively utilizes heat energy generated in the combustion furnace.

According to the present invention, the heat exchange for combustive oxygen for cooling the gasification furnace or combustive oxygen supplied to the gasification furnace and/or the combustion furnace is carried out by providing a heat exchanger with a combustive oxygen conduit disposed therein in a passage of the waste gases from said combustion furnace, and passing combustive oxygen through the combustive oxygen conduit upstream in the passage of the waste gases. The flow of the waste gases and the flow of the combustive oxygen passing through the combustive oxygen conduit are directed opposite to each other. The combustive oxygen is initially heated by a heat exchange with the waste gases at a relatively low temperature, and then further heated by a heat exchange with the waste gases at a relatively high temperature. Thus, an excellent heat exchange efficiency is achieved.

BEST MODE FOR CARRYING OUT THE INVENTION

Figure 1:
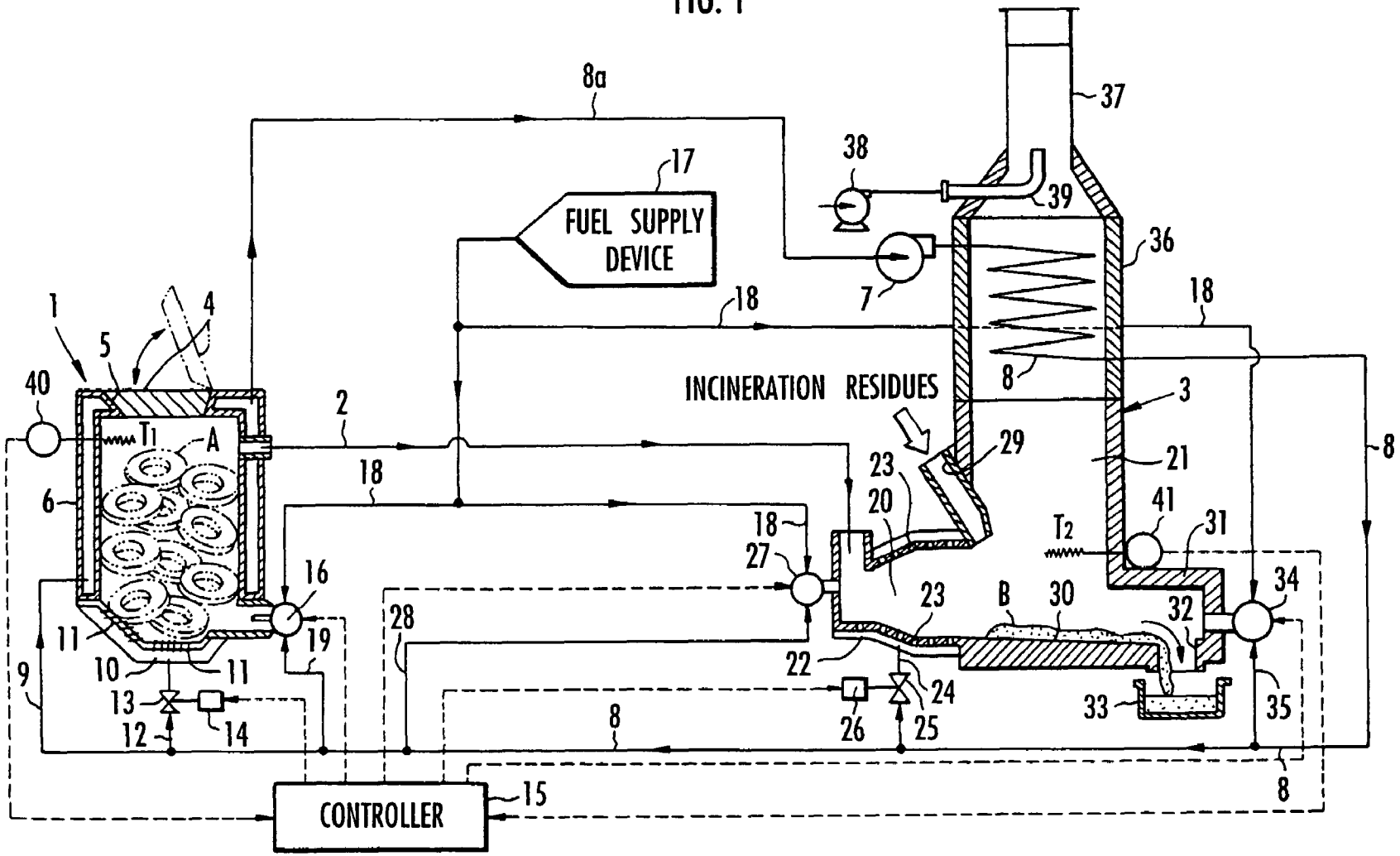
FIG. 1 is a diagram showing a system arrangement of an apparatus for gasifying and incinerating a waste material by way of dry distillation, which is used in an embodiment of the present invention.

As shown in FIG. 1, an apparatus for gasifying and incinerating a waste material by way of dry distillation according to an embodiment of the present invention has a gasification furnace 1 for placing therein a waste material A such as waste tires or the like, and a combustion furnace 3 connected to the gasification furnace 1 by a gas passage 2. The gasification furnace 1 has a charge inlet 5 defined in an upper wall thereof and having an openable and closable charge door 4. The waste material A can be charged into the gasification furnace 1 through the charge inlet 5. When the charge door 4 is closed, the interior space of the gasification furnace 1 is virtually isolated from the ambient space.

An air jacket 6 for being supplied with air for cooling the gasification furnace 1 to prevent the gasification furnace 1 from being overheated is disposed around the gasification furnace 1 in isolation from the interior space of the gasification furnace 1. The air jacket 6 is connected by a cooling air supply passage 9 to a main air supply passage 8 which extends from an air blower fan 7 serving as an air supply outside the gasification furnace 1 and the combustion furnace 3. Air delivered from the air blower fan 7 to the main air supply passage 8 is supplied via the cooling air supply passage 9 to the air jacket 6.

In the present embodiment, the air blower fan 7 serves to supply air for cooling the gasification furnace 1 to the air jacket 6, and also functions as an oxygen supply for supplying combustive oxygen (specifically air containing such oxygen) which is required to burn a portion of the waste material A in the gasification furnace 1 and a combustible gas, described later, in the combustion furnace 3. The air supplied to the air jacket 6 is discharged from a discharge port, not shown, and circulated via an air retrieval passage 8*a* to the air blower fan 7.

The gasification furnace 1 has a downwardly projecting frustoconical lower wall surrounded by an empty chamber 10 isolated from the interior space of the gasification furnace 1 and the air jacket 6. The empty chamber 10 serves to supply oxygen (air) required to burn a portion of the waste material A in the gasification furnace 1 into the gasification furnace 1, and is held in communication with the interior space of the gasification furnace 1 through a plurality of air supply nozzles 11 mounted in an inner wall of the gasification furnace 1.

To the empty chamber 10, there is connected a first air supply passage 12 branched from the main air supply passage 8. The empty chamber 10 is supplied with air containing oxygen which is delivered from the air blower fan 7 into the main air supply passage 8, through the first air supply passage 12. The first air supply passage 12 has a control valve 13 for controlling the amount of air (the amount of oxygen) supplied to the empty chamber 10. The control valve 13 is controlled for its opening by a valve actuator 14 which is controlled by a controller 15 comprising an electronic circuit including a CPU, etc.

An igniter 16 is mounted on a lower wall of the gasification furnace 1 for igniting the waste material A placed in the gasification chamber 1 under operation control of the controller 15. The igniter 16 comprises an ignition burner or the like and burns a fuel supplied from a fuel supply device 17 which stores a combustion assistant oil such as kerosine or the like, thus supplying flames to the waste material A. Oxygen (air) required to burn the fuel in the igniter 16 is supplied through a second air supply passage 19 branched from the main air supply passage 8, by the air blower fan 7.

The combustion furnace 3 comprises a burner section 20 for mixing a combustible gas produced upon dry distillation of the waste material A and oxygen (air) needed for complete combustion of the combustible gas, and a combusting section 21 for combusting the combustible gas which is mixed with oxygen. The combusting section 21 is held in communication with the burner section 20 downstream of the burner section 20. The gas passage 2 is connected to an upstream end of the burner section 20 for introducing the combustible gas produced upon dry distillation of the waste material A in the gasification furnace 1 into the burner section 20.

The burner section 20 has an empty chamber 22 defined in an outer surface thereof and isolated from the interior space of the burner section 20. The empty chamber 22 serves to supply oxygen (air) to be mixed with the combustible gas, and is held in communication with the interior space of the burner section 20 through a plurality of nozzle holes 23 defined in an inner circumferential wall of the burner section 20. A third air supply passage 24 branched from the main air supply passage 8 is connected to the empty chamber 22. The empty chamber 22 is supplied with oxygen (air) delivered from the air blower fan 7 into the main air supply passage 8, through the third air supply passage 24.

The third air supply passage 24 has a control valve 25 for controlling the amount of oxygen (the amount of air) supplied to the empty chamber 22. The control valve 25 is adjusted in its opening by a valve actuator 26 which is controlled by the controller 15, as with the control valve 13 associated with the gasification furnace 1.

A combustor 27 is connected to the upstream end of the burner section 20 for burning a combustion assistant oil supplied from the fuel supply device 17 through a fuel supply passage 18. The combustor 27 comprises an ignition burner or the like for burning the combustion assistant boil together with the combustible gas, if necessary, for warming up in the combustion furnace 3 under operation control of the controller 15. The combustor 27 is also used to ignite the combustible gas introduced into the burner section 20. Oxygen (air) required to burn the fuel in the combustor 27 is supplied through a fourth air supply passage 28 branched from the main air supply passage 8, by the air blower fan 7.

A residue chute 29 which serves as an incineration residue charging port for charging incineration residues (not shown) of the waste material into the combusting section 21 is mounted on a side wall of the combusting section 21 near the burner section 20. The residue chute 29 extends from outside the combustion furnace 3 obliquely downwardly toward a furnace floor 30 of the combusting section 21.

The combusting section 21 has a projection 31 extending outwardly from a lower side wall thereof remote from the burner section 20. The projection 21 has a melted material outlet 32 defined in a lower wall thereof for allowing a melted material B of the incineration residues to flow out of the combustion furnace 3. A melted material receptacle 33 is placed below the melted material outlet 32 (outside the combustion furnace 3) for storing and cooling the melted material B which has flowed from the melted material outlet 32.

The furnace floor 30 of the combusting section 21 is slanted such that it is lower at the melted material outlet 32 than at the burner section 20, as shown, for guiding the melted material B into the melted material outlet 32. The furnace floor 30 of the combusting section 21 is made of chromium containing 25% or more of chromium in order to prevent itself from being eroded by the melted material B at a high temperature.

A combustor 34 is mounted on the tip end of the projection 31 of the combusting section 21 for heating and keeping hot the interior space of the projection 31, i.e., a portion thereof near the melted material outlet 32. The combustor 34 comprises an ignition burner or the like and burns a combustion assistant oil supplied from the fuel supply device 17 through the fuel supply passage 18 under operation control of the controller 15. Oxygen (air) required to burn the fuel in the combustor 34 is supplied through a fifth air supply passage 35 branched from the main air supply passage 8, by the air blower fan 7.

A heat exchanger 36 is disposed downstream of the combusting section 21. The heat exchanger 36 is held in communication with the combusting section 21 and positioned in a passage of waste gases that are generated by the complete combustion of the combustible gas in the combusting section 21. The main air supply passage 8 has a helically coiled portion disposed in heat exchanger 36 and extending from an upper portion toward a lower portion thereof. As a result, in the heat exchanger 36, air passing through the main air supply passage 8 flows upstream in the passage of waste gases, and is heated by a heat exchange that is effected between the air and the waste gases that flow in the direction opposite to the air.

A stack 37 is mounted on the upper end of the heat exchanger 36 in communication with a downstream end of the heat exchanger 36. The stack 37 has an inductive nozzle 39 for ejecting air supplied from an air blower fan 38 disposed outside the stack 37, upwardly in the stack 37. The inductive nozzle 39 ejects the air supplied from the air blower fan 38 upwardly in the stack 37 to induct the waste gases after they have performed the heat exchange in the heat exchanger 36, and discharge the waste gases from the stack 37 into the atmosphere.

In the apparatus according to the present embodiment, a temperature sensor 40 for detecting a temperature $T_1$ in the gasification furnace 1 is mounted in an upper portion of the gasification furnace 1. A temperature sensor 41 for detecting a temperature $T_2$ in the combustion furnace 3 is mounted in the combustion furnace 3 in facing relation to the tip end of the burner section 20. Detected signals from these temperature sensors 40, 41 are inputted to the controller 15.

A basic operation sequence (in which the incineration residues are not melted) of a method of incinerating waste materials which is carried out by the apparatus according to the embodiment of the present invention will be described below with reference to FIGS. 1 and 2.

To incinerate a waste material A with the apparatus shown in FIG. 1, the charge door 4 of the gasification furnace 1 is opened, and the waste material A such as waste tires or the like is charged into the gasification furnace 1 through the charge inlet 5. Then, the charge door 4 is closed to seal the gasification furnace 1, and a lower layer of the waste material A is ignited by the igniter 16. When partial combustion of the waste material A begins, the temperature $T_1$ in the gasification furnace 1 which is detected by the temperature sensor 40 gradually rises up to a predetermined temperature $T_{1A}$ (see FIG. 2), whereupon the igniter 16 is inactivated.

When the waste material A is ignited, the control valve 13 of the first air supply passage 12 is opened to a relatively small opening by the valve actuator 14. As a result, the waste material A is ignited using oxygen present in the gasification furnace 1 and a small amount of oxygen supplied from the air blower fan 7 through the main air supply passage 8, the first air supply passage 12, and the empty chamber 10 into the gasification furnace 1.

When the partial combustion of the lower layer of the waste material A in the gasification furnace 1 beings, the heat of combustion sets off dry distillation of an upper layer of the waste material A, producing a combustible gas that are introduced via the gas passage 2 into the burner section 20 of the combustion furnace 3. After the ignition of the waste material A, the opening of the control valve 13 of the first air supply passage 12 gradually increases, supplying the lower layer of the waste material A with an amount of oxygen that is required and sufficient to continuously burn the waste material A. As a result, the combustion of the waste material A is stabilized, but not unnecessarily expanded, in the lower layer thereof, and the dry distillation of the waste material A is stably carried out in the upper layer thereof.

The combustor 27 of the combustion furnace 3 has been operated prior to the ignition of the waste material A. When the combustible gas is introduced into the burner section 20, the temperature $T_2$ in the combustion furnace 3 has been risen to 850° C. or higher, e.g., 870° C., for example. Even if the combustible gas contains dioxins, the dioxins are thermally decomposed in the above temperature environment, and are prevented from being emitted into the atmosphere.

When the combustible gas is introduced into the burner section 20, the control valve 25 of the third air supply passage 24 has been opened to a predetermined opening by the valve actuator 26. The combustible gas is thus mixed with oxygen supplied from the third air supply passage 24 through the empty chamber 22, and are ignited by the combustor 27 and start to burn.

When the combustible gas starts to burn, the combustible gas may not be supplied stably. However, as the dry distillation in the gasification furnace 1 is stabilized, as described above, the combustible gas is continuously generated. As the generated amount of combustible gas increases, the temperature $t_2$ at which the combustible gas is combusted in the combustion furnace 3 gradually increases as indicated by the imaginary curve in FIG. 2. The controller 15 adjusts the flame power of the combustor 27 such that the temperature $T_2$ in the combustion furnace 3 as detected by the temperature sensor 41 is kept at 850° C. or higher. When the temperature $t_2$ at which the combustible gas is combusted reaches 850° C. or higher, the combustor 27 is automatically inactivated, and the combustible gas is burned of its own accord.

When the combustible gas is burned of its own accord, the temperature $t_2$ is brought into conformity with the temperature $T_2$ in the combustion furnace 3 as detected by the temperature sensor 41. If the temperature $T_2$ in the combustion furnace 3 as detected by the temperature sensor 41 is lower than a preset temperature $T_{2A}$, then the controller 15 increases the amount of oxygen supplied to the gasification furnace 1 to promote the dry distillation of the waste material A in the gasification furnace 1 for thereby increasing the generated amount of combustible gas. If the temperature $T_2$ is higher than the preset temperature $T_{2A}$, then the controller 15 reduces the amount of oxygen supplied to the gasification furnace 1 to suppress the dry distillation of the waste material A for thereby reducing the generated amount of combustible gas. The amount of oxygen supplied to the gasification furnace 1 is thus controlled to automatically adjust the amount of combustible gas generated in the gasification furnace 1 to keep the temperature $T_2$ at the preset temperature $T_{2A}$.

At the same time, until the temperature $T_2$ in the combustion furnace 3 reaches the preset temperature $T_{2A}$, the controller 15 increases the opening of the control valve 25 to increase the amount of oxygen supplied to the combustion furnace 3. After the temperature $T_2$ has reached the preset temperature $T_{2A}$, if the temperature $T_2$ drops below the preset temperature $T_{2A}$, then the controller 15 reduces the amount of oxygen supplied to the combustion furnace 3, and if the temperature $T_2$ becomes higher than the preset temperature $T_{2A}$, then the controller 15 increases the amount of oxygen supplied to the combustion furnace 3. By thus controlling the amount of oxygen supplied to the combustion furnace 3, an amount of oxygen required and sufficient to fully combust the combustible gas introduced from the gasification furnace 1 is supplied to the combustion furnace 3, allowing the combustible gas to be fully combusted in the combusting section 21 of the combustion furnace 3.

The above control of the amount of oxygen supplied to the gasification furnace 1 and the combustion furnace 3 keeps the temperature $T_2$ in the combustion furnace 3 substantially at the preset temperature $T_{2A}$.

The temperature $T_1$ in the gasification furnace 1 as detected by the temperature sensor 40 rises due to the partial combustion of the lower layer of the waste material A immediately after the waste material A is ignited, and thereafter temporarily falls because the heat of combustion of the lower layer of the waste material A is consumed for the dry distillation of the upper layer of the waste material A. When the combustor 27 is inactivated and the combustible gas is combusted of its own accord, the dry distillation enters a stage in which it progresses stably and steadily (indicated as a stable dry distillation stage in FIG. 2), and the temperature $T_1$ gradually rises as the dry distillation progresses.

As the dry distillation of the waste material A progresses and the portion of the waste material A which can be dry-distilled is reduced, the required amount of combustible gas cannot be produced even when the amount of oxygen supplied into the gasification furnace 1 is increased to maintain the temperature $T_2$ in the combustion furnace 3 at the preset temperature $T_{2A}$, and the amount of combustible gas introduced into the combustion furnace 3 is gradually reduced. As a result, the temperature $T_2$ in the combustion furnace 3 drops from the preset temperature $T_{2A}$. Shortly, the temperature $t_2$ at which the combustible gas is burned also drops as indicated by the imaginary curve in FIG. 2. When the heat of combustion of the combustible gas alone is not enough to keep the temperature $T_2$ in the combustion furnace 3 at the temperature of 850° C. or higher, the combustor 27 is actuated again to keep the temperature $T_2$ in the combustion furnace 3 at 850° C. or higher.

Figure 2:
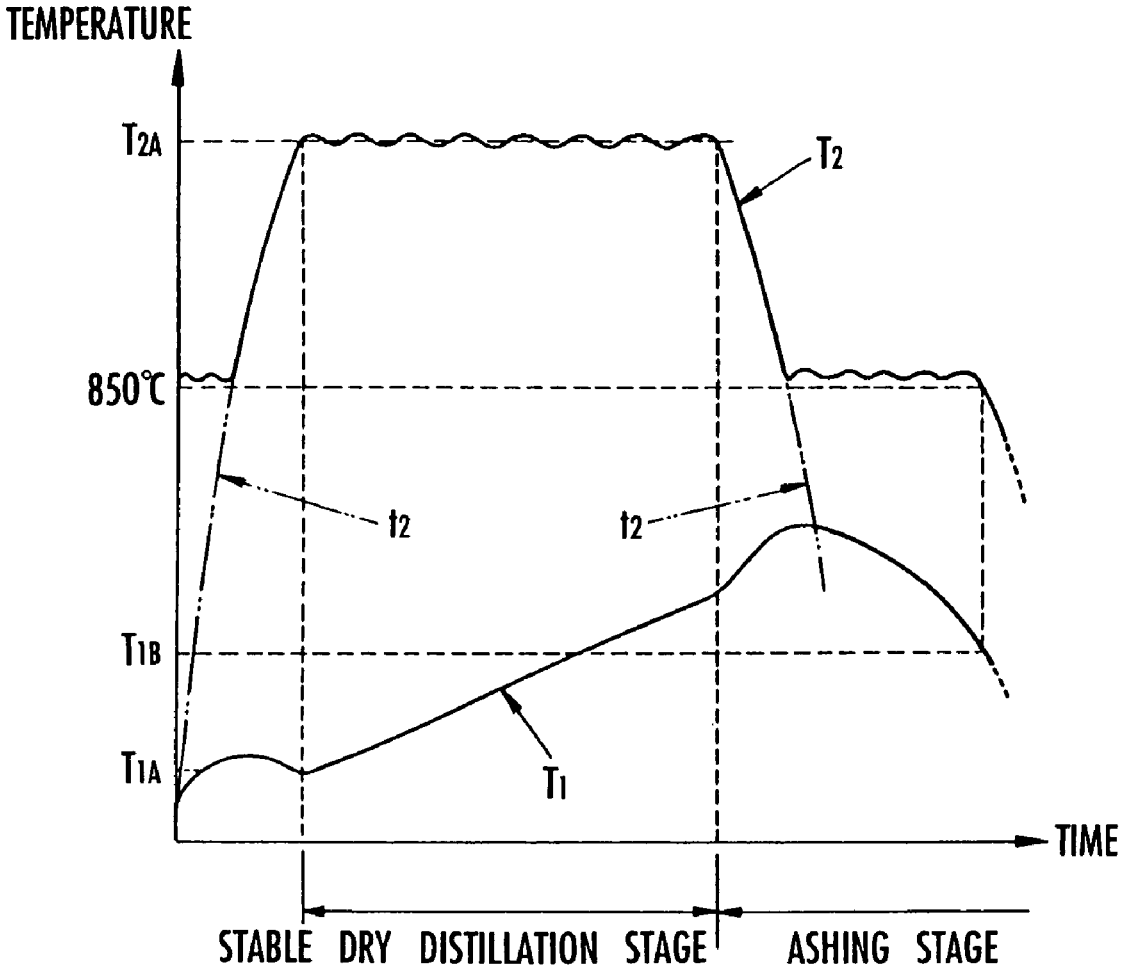
FIG. 2 is a graph showing the temperature in a gasification furnace and the temperature in a combustion furnace as they change with time in a basic operation of the apparatus shown in FIG. 1.

When the portion of the waste material A which can be dry-distilled is eliminated and the waste material A is directly burned, the temperature $T_1$ in the gasification furnace 1 rises temporarily sharply as shown in FIG. 2. When any combustible portion of the waste material A is gone, the temperature $T_1$ in the gasification furnace 1 begins to drop and gradually decreases as the waste material A is ashed (indicated as an ashing stage in FIG. 2). When the temperature $T_1$ in the gasification furnace 1 falls to a predetermined temperature $T_{1B}$ (e.g., 200° C. or less) at which no dioxins are produced, since the temperature $T_2$ in the combustion furnace 3 is no longer required to be kept at 850° C. or higher, the combustor 27 is inactivated. As a result, the temperature $T_2$ in the combustion furnace 3 is gradually lowered, and the process of incinerating the waste material A is finished.

After the incinerating process is finished, the ashes of the waste material A remain as the incineration residues in the gasification furnace 1. With the apparatus according to the present embodiment, the incineration residues are removed from an ash outlet, not shown, and charged into the combustion furnace 3 and melted therein in a next cycle of operation.

An operation sequence of the apparatus according to the present embodiment for melting the incineration residues simultaneously with the incineration of the waste material will be described below.

For melting the incineration residues, as with the basic operation described above, the charge door 4 of the gasification furnace 1 is opened, and the waste material A such as waste tires or the like is charged into the gasification furnace 1 through the charge inlet 5. Then, the igniter 16 is actuated to ignite a lower layer of the waste material A. While the waste material A may be waste tires or the like, it may be mixed with a waste material such as waste plastics or the like in order to be able to generate a high-calorie combustible gas by way of dry distillation.

The combustible gas generated by the dry distillation of the waste material A in the gasification furnace 1 is introduced into the combustion furnace 3, which starts to burn the combustible gas as with the basic operation described above. In order to make the incineration residues (which are basically ashes, but may contain materials not completely ashed) meltable after the dry distillation of the waste material A in the gasification furnace 1, the temperature $T_2$ in the combustion furnace 3 is set to a preset temperature which is higher than the normal preset temperature $T_{2A}$. The preset temperature for making the incineration residues meltable (hereinafter referred to as "melting preset temperature") is specifically set to 1400° C. or higher, e.g., 1450° C. (see FIG. 3).

In order to melt the incineration residues in the combustion furnace 3, the incineration residues need to be charged into the combustion furnace 3 while the temperature $T_2$ in the combustion furnace 3 is being maintained at the melting preset temperature (e.g., 1450° C.) at which the incineration residues are meltable. For melting as much incineration residues in the combustion furnace 3 as possible, it is preferable to maintain the temperature $T_2$ in the combustion furnace 3 at the melting preset temperature for as long a period of time as possible. Stated otherwise, it is preferable to produce, continuously for as long a period of time as possible, an amount of combustible gas large enough to keep the temperature $T_2$ in the combustion furnace 3 at the melting preset temperature.

According to the present embodiment, air supplied to the air jacket 6 for cooling the gasification furnace 1, the interior space of the gasification furnace 1, and the burner section 20 of the combustion furnace 3 is heated by the heat of waste gases produced when the combustible gas is burned in the combustion furnace 3.

Specifically, air (at normal temperature in the present embodiment) delivered from the air blower fan 7 into the main air supply passage 8 passes through the heat exchanger 36 which is supplied with the waste gases from the combustion furnace 3. Therefore, while the combustible gas is being burned in the combustion furnace 3, the above air (containing oxygen) as it flows through the heat exchanger 36 is heated to a temperature of about 300° C., for example, by a heat exchange with the waste gases.

The heated air is supplied from the main air supply passage 8 into the air jacket 6 of the gasification furnace 1, the interior space of the gasification furnace 1, and the burner section 20 of the combustion furnace 3.

In the gasification furnace 1, therefore, the portion of the amount of heat generated by the partial combustion of the waste material A upon the dry distillation, which portion is absorbed by the air supplied to the air jacket and the air (oxygen) supplied to the gasification furnace 1 for the partial combustion of the waste material A, may be reduced. As a result, much of the heat generated by the partial combustion of the waste material A in the gasification furnace 1 is used for dry distillation of the other portion of the waste material A. Therefore, whereas the combusted portion of the waste material A is small, the other portion of the waste material A is increased and sufficiently subject to dry distillation.

Accordingly, it is possible to generate a combustible gas continuously for a relatively long period of time, in an amount large enough to keep the temperature $T_2$ in the combustion furnace 3 at the melting preset temperature.

Inasmuch as the temperature $T_1$ in the gasification furnace 1 rises to a temperature higher than the temperature of the air supplied to the air jacket 6 during dry distillation of the waste material A, the furnace body of the gasification furnace 1 is sufficiently prevented from being overheated by the air.

In the combustion furnace 3, since the air (oxygen) heated as described above is supplied to the burner section 2 and mixed with the combustible gas, the portion of the amount of heat generated by the combustion of the combustible gas, which portion is absorbed by the air supplied to the burner section 20, may be small. As a consequence, the amount of combustible gas which is required to keep the temperature $T_2$ in the combustion furnace 3 at the melting preset temperature may be small.

Figure 3:
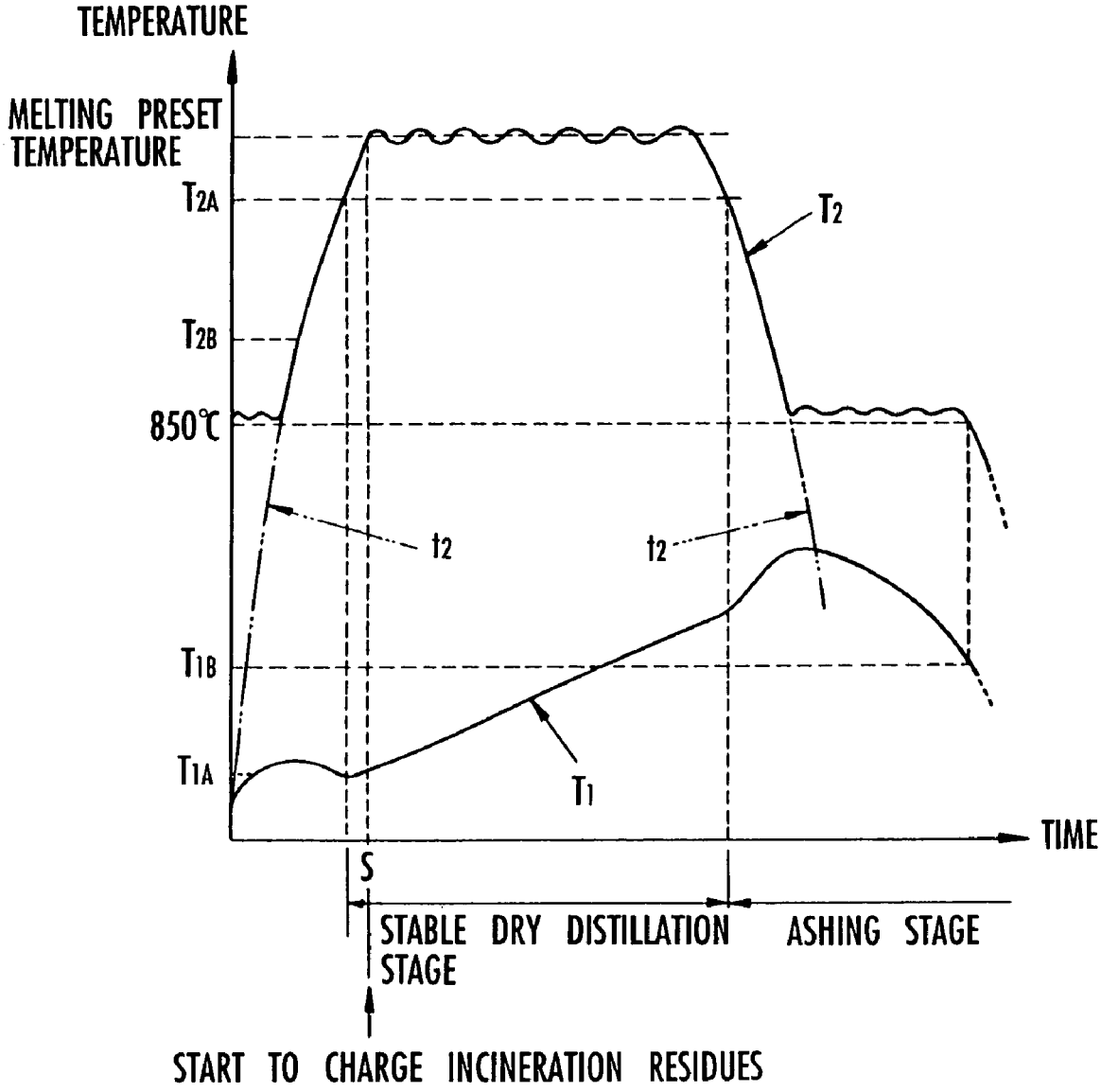
FIG. 3 is a graph showing the temperature in the gasification furnace and the temperature in the combustion furnace as they change with time in the apparatus shown in FIG. 1 according to an inventive example.

As a result, as indicated by the imaginary curve in FIG. 3, the temperature $t_2$ at which the combustible gas is combusted in the combustion furnace 3 gradually increases toward the melting preset temperature. When the temperature $t_2$ reaches the melting preset temperature, the temperature $T_2$ in the combustion furnace 3 is kept at the melting preset temperature in the same manner as the above basic operation in which the temperature $T_2$ in the combustion furnace 3 is kept at the preset temperature $T_{2A}$.

With the apparatus according to the present embodiment, therefore, the period of time for which the temperature $T_2$ in the combustion furnace 3 is kept at the high melting preset temperature of 1400° C. or higher, e.g., 1450° C., can be relatively long without specially increasing the capacity of the gasification furnace 1 and the amount of waste material A placed therein. The incineration residues can be melted in a sufficient quantity in the combustion furnace 3 within the period of time for which the temperature $T_2$ in the combustion furnace 3 can be kept at the melting preset temperature.

In a process in which the temperature $T_2$ in the combustion furnace 3 is increasing toward the melting preset temperature before the temperature $T_2$ is kept at the melting preset temperature, if the temperature $T_2$ in the combustion furnace 3 reaches a predetermined temperature $T_{2B}$ (see FIG. 3), e.g., 1000° C., which is lower than the melting preset temperature, then the controller 15 operates the combustor 34 mounted on the tip end of the projection 31 of the combustion furnace 3 to start heating the interior space of the projection 31 near the melted material outlet 32. Because the combustor 34 starts operating at the predetermined temperature $T_{2B}$ before the temperature $T_2$ in the combustion furnace 3 reaches the melting preset temperature, the temperature in the projection 31 rises to a temperature which is substantially equal to the melting preset temperature when the temperature $T_2$ in the combustion furnace 3 as detected by the temperature sensor 41 rises to the melting preset temperature.

Once the combustor 34 has started to operate, it is inactivated when the temperature $T_2$ in the combustion furnace 3 becomes higher than the melting preset temperature. The combustor 34 is operated again when the temperature $T_2$ in the combustion furnace 3 drops below the melting preset temperature. In this manner, the temperature in the projection 31 is kept at a temperature close to the melting preset temperature.

When the temperature $T_2$ in the combustion furnace 3 increases to the melting preset temperature and is kept at the melting preset temperature (at a time S in FIG. 3), an incineration residue charge device such as a conveyor or the like (not shown) disposed outside the combustion furnace 3 is activated by the controller 15 to charge the incineration residues (not shown) from the residue chute 29 into the combusting section 21 of the combustion furnace 3.

A fluxing agent has been mixed with the incineration residues in order to lower the melting point thereof. The fluxing agent may comprise one or a mixture of two or more of silicic acid, silicic acid compound, a material mainly containing silicic acid, boric acid, boric acid compound, a material mainly containing boric acid, an alkali metal compound, and an alkali earth metal compound.

The silicic acid compound or the material mainly containing silicic acid may be silica sand, mountain sand, river sand, silica stone, diatomaceous earth, sodium silicate, magnesium silicate, glass debris, clay, etc. The boric acid may be either orthoboric acid, metaboric acid, tetraboric acid, or boron oxide. The boric acid compound or the material mainly containing boric acid may be orthoborate, metaborate, tetraborate, diborate, pentaborate, hexaborate, octaborate, borax, calcium borate, or the like.

The alkali metal compound may be soda ash, salt, caustic soda, or the like. The alkali earth metal compound may be lime, slaked lime, limestone, or the like.

The residue chute 29 is closed by an openable and closable door, not shown, when no incineration residues are charged. The time S to start charging the incineration residues is a predetermined time after the temperature $T_2$ in the combustion furnace 3 has reached the melting preset temperature, for example.

The incineration residues are gradually charged bit by bit from the residue chute 28 into the combusting section 21 of the combustion furnace 3. At this time, the temperature $T_2$ in the combustion furnace 3 is kept substantially at the melting preset temperature (e.g., 1450° C.) at which the incineration residues are melted. The incineration residues have been mixed with a fluxing agent such as silica sand or limestone for lowering the melting point thereof. Therefore, each time the incineration residues are charged, the incineration residues are quickly melted into a melted material B in the combusting section 21 of the combustion furnace 3. If dioxins are contained in the incineration residues, then the dioxins are thermally decomposed when the incineration residues are melted.

The melted material B which is produced when the incineration residues are melted flows on the furnace floor 30 of the combusting section 21 toward the melted material outlet 32 in the projection 31, then flows out of the combustion furnace 3 through the melted material outlet 32, and drops into and is stored in the melted material receptacle 33. Since the interior space of the projection 31 is kept at a temperature close to the melting preset temperature, the melted material B is not cooled and solidified by ambient air when it flows out from the melted material outlet 32. Therefore, the incineration residues melted in the combustion furnace 3 (the melted material B) flow in their entirety smoothly from the melted material outlet 32 into the melted material receptacle 33.

The melted material B stored in the melted material receptacle 33 is slowly cooled and solidified into a solid material by natural air cooling. By cooling the melted material B slowly, the solid material becomes excellent in strength and rigidity, and can be used as a good material of the aggregate for building and construction use. As the melted material B contains vitreous silica sand, heavy metals contained in the incineration residues are well trapped in the solid material and prevented from leaking out.

Before the incineration residues are charged, the melted material outlet 32 is closed by an openable and closable door, not shown. The amount of incineration residues to be charged into the combustion furnace 3 and the time at which the incineration residues to be charged into the combustion furnace 3 are adjusted in advance such that the melting of the incineration residues and the flowing of the melted material B out of the melted material outlet 32 are completed while the temperature $T_2$ in the combustion furnace 3 is being continuously kept at the melting preset temperature, When the portion of the waste material A which can be dry-distilled is eliminated and the waste material A is directly burned, and the combustible portion of the waste material A is gone, thus entering the ashing stage, the temperature $T_1$ in the gasification furnace 1 and the temperature $T_2$ in the combustion furnace 3 are gradually lowered, putting the process of incinerating the waste material A to an end as with the basic operation described above. After the incinerating process is finished, the incineration residues of the waste material A are removed from the ash outlet (not shown) of the gasification furnace 1, and charged into the combustion furnace 3 and melted therein in a next cycle of operation.

According to the present embodiment, as described above, since a sufficient amount of incineration residues can be melted in the combustion furnace 3, no dedicated melting furnace is required, and the waste material A can be incinerated and the incineration residues can thereafter be processed (melted and solidified) efficiently with a small-size, simple facility which employs the existing gasification furnace 1 and the existing combustion furnace 3.

In the above embodiment, incineration residues produced after the waste material A are dry-distilled in the gasification furnace 1 are employed as the incineration residues to be introduced into the combustion furnace 3. However, incineration residues produced when waste materials such as municipal waste, sewage sludge, industrial waste, etc. are combusted may be employed as the incineration residues to be introduced into the combustion furnace 3.

In the present embodiment, the stack 37 is provided in communication with the heat exchanger 36 for discharging waste gases used to heat air with the heat exchanger 36 immediately from the stack 37 into the atmosphere. However, a duct may be disposed downstream of the heat exchanger 36 for guiding waste gases through the duct to the stack 37. A cyclone, a cooling tower, a bug filter, etc. may be provided in the duct for trapping and removing dust and ashes contained in the waste gases. With such a modification, the air blower fan 38 and the inductive nozzle 39 may be disposed in the duct in front of the stack 37.

In the present embodiment, the air heated by the heat exchanger 36 is supplied to the air jacket 6, the gasification furnace 1, and the combustion furnace 3 after the combustible gas starts being combusted in the combustion furnace 3. However, the heated air may be supplied to the air jacket 6 and the gasification furnace 1 before the waste material A is ignited in the gasification furnace 1. In the combustion furnace 3, before the waste material A is ignited, the combustor 27 is operated to burn the combustion assistant oil to increase the temperature $T_2$ in the combustion furnace 3 to 850° C. or higher. The heat produced by burning combustion assistant oil heats the air which is introduced from the main air supply passage 8 into the heat exchanger 36. In this manner, the time required until the dry distillation in the gasification furnace 1 is stabilized can be shortened, and it is possible to generate an increased amount of combustible gas.

Inventive and comparative examples of the present invention will be described below.

INVENTIVE EXAMPLE

In the inventive example, the apparatus shown in FIG. 1 was used, and after the waste material A in the gasification furnace 1 was ignited, the air heated by the heat exchanger 36 was supplied to the air jacket 6, the gasification furnace 1, and the combustion furnace 3, thus incinerating the waste material A and melting the incineration residues. The incineration residues were produced in advance by incinerating the waste material A with the apparatus shown in FIG. 1.

In the inventive example, the melting preset temperature was set to 1450° C., and the temperature of the heated air was about 300° C. in incinerating the waste material A and melting the incineration residues.

As a result, in the inventive example, as shown in FIG. 3, when the process entered the stable dry distillation stage, the temperature $T_2$ in the combustion furnace 3 easily reached the melting preset temperature and was continuously kept substantially at the melting preset temperature, so that a sufficient amount of incineration residues could be melted.

COMPARATIVE EXAMPLE

In the comparative example, the apparatus shown in FIG. 1 was modified such that the main air supply passage 8 bypassed the heat exchanger 36 from the inlet to the outlet thereof and did not pass through the heat exchanger 36, and the waste material A was incinerated and the incineration residues were melted in the same manner as the inventive example. In the comparative example, air supplied at the normal temperature from the air flow fan 7 was introduced into the air jacket 6, the gasification furnace 1, and the combustion furnace 3, which were not supplied with any heated air.

Figure 4:
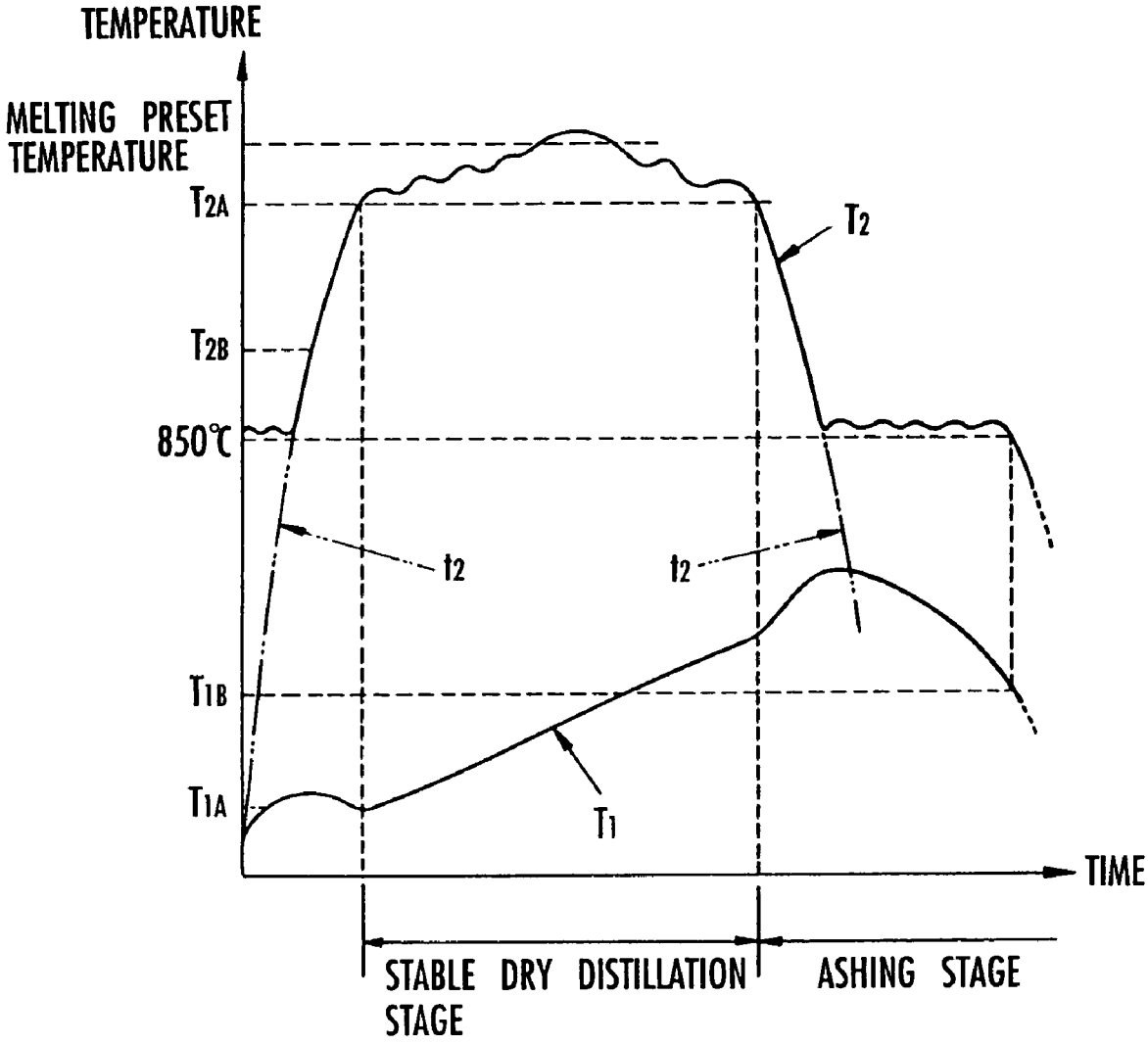
FIG. 4 is a graph showing the temperature in the gasification furnace and the temperature in the combustion furnace as they change with time in the apparatus shown in FIG. 1 according to a comparative example.

As a result, in the comparative example, as shown in FIG. 4, when the process entered the stable dry distillation stage, the temperature $T_2$ in the combustion furnace 3 did not easily reach the melting preset temperature and was kept at the melting preset temperature only for a brief period of time. Therefore, the incineration residues could hardly be melted.

It will be seen from the above inventive and comparative examples that when the air heated by the heat exchanger 36 is supplied to the air jacket 6, the gasification furnace 1, and the combustion furnace 3 to incinerate the waste material A, the temperature $T_2$ in the combustion furnace 3 can easily be brought to a high temperature of 1450° C. for melting the incineration residues, and can be maintained continuously at the high temperature for a long period of time.

In the inventive example, after the waste material A in the gasification furnace 1 was ignited, the heated air was supplied to the air jacket 6, the gasification furnace 1, and the combustion furnace 3. However, when the heated air was supplied to the air jacket 6 and the gasification furnace 1 before the waste material A was ignited, the time required for the temperature $T_2$ in the combustion furnace 3 to reach the melting preset temperature was shorter than the time in the inventive example. Furthermore, the temperature $T_2$ in the combustion furnace 3 was kept at the melting preset temperature for a longer period of time than the period of time in the inventive example.

INDUSTRIAL APPLICABILITY

According to the present invention, at the same time that a waste material such as waste tires or the like is incinerated, incineration residues of waste materials such as municipal waste, sewage sludge, industrial waste, etc. are melted, and the melted incineration residues can be cooled and solidified.

The invention claimed is:

1. A method of incinerating a waste material, having the steps of combusting a portion of the waste material placed in a gasification furnace having an interior space substantially isolated from an exterior space and subjecting the other portion of the waste material to dry distillation with heat produced by the combustion of the portion of the waste material, and introducing a combustible gas generated by the dry distillation into a combustion furnace disposed outside said gasification furnace and combusting the combustible gas in the combustion furnace, wherein oxygen required to combust the combustible gas introduced into said combustion furnace is supplied depending on the amount of the combustible gas into the combustion furnace to combust the combustible gas, and the amount of oxygen supplied to said gasification furnace is controlled depending on a change in the temperature in the combustion furnace such that the temperature in the combustion furnace is kept at a predetermined temperature, for thereby adjusting the amount of the combustible gas generated by the dry distillation, said method being characterized in that, said gasification furnace comprises an air-cooled gasification furnace, said method being characterized by the steps of:

supplying combustive oxygen heated by a heat exchange with waste gases from said combustion furnace, to cool said gasification furnace;

performing a heat exchange between the combustive oxygen supplied to cool said gasification furnace and the waste gases from said combustion furnace, and supplying the heated combustive oxygen to said gasification furnace and/or said combustion furnace, said predetermined temperature being set to a temperature at which incineration residues produced when the waste material is incinerated are meltable; and charging said incineration residues into the combustion furnace from an incineration residue charging port thereof to melt the incineration residues with the heat generated when the combustible gas is combusted, while the combustible gas is being combusted in said combustion furnace, and discharging a melted material converted from the incineration residues out of the combustion furnace from a melted material outlet thereof and cooling the melted material into a solid material, further characterized in that said incineration residues are gradually charged into said combustion furnace after the temperature in said combustion furnace rises to a temperature close to said predetermined temperature after the dry distillation of said waste material is started in said gasification furnace.

2. A method of incinerating a waste material according to claim 1, characterized in that said heat exchange is carried out by providing a heat exchanger with an air conduit disposed therein in a passage of the waste gases from said combustion furnace, and passing air through said air conduit upstream in the passage of the waste gases.

3. A method of incinerating a waste material, having the steps of combusting a portion of the waste material placed in a gasification furnace having an interior space substantially isolated from an exterior space and subjecting the other portion of the waste material to dry distillation with heat produced by the combustion of the portion of the waste material, and introducing a combustible gas generated by the dry distillation into a combustion furnace disposed outside said gasification furnace and combusting the combustible gas in the combustion furnace, wherein oxygen required to combust the combustible gas introduced into said combustion furnace is supplied depending on the amount of the combustible gas into the combustion furnace to combust the combustible gas, and the amount of oxygen supplied to said gasification furnace is controlled depending on a change in the temperature in the combustion furnace such that the temperature in the combustion furnace is kept at a predetermined temperature, for thereby adjusting the amount of the combustible gas generated by the dry distillation, said method being characterized in that, said gasification furnace comprises an air-cooled gasification furnace, said method being characterized by the steps of:

supplying combustive oxygen heated by a heat exchange with waste gases from said combustion furnace, to cool said gasification furnace;

performing a heat exchange between the combustive oxygen supplied to cool said gasification furnace and the waste gases from said combustion furnace, and supplying the heated combustive oxygen to said gasification furnace and/or said combustion furnace, said predetermined temperature being set to a temperature at which incineration residues produced when the waste material is incinerated are meltable;

charging said incineration residues into the combustion furnace from an incineration residue charging port thereof to melt the incineration residues with the heat generated when the combustible gas is combusted, while the combustible gas is being combusted in said combustion furnace, and discharging a melted material converted from the incineration residues out of the combustion furnace from a melted material outlet thereof and cooling the melted material into a solid material; and adding a fluxing agent to said incineration residues before the incineration residues are charged into said combustion furnace, further characterized in that said incineration residues are gradually charged into said combustion furnace after the temperature in said combustion furnace rises to a temperature close to said predetermined temperature after the dry distillation of said waste material is started in said gasification furnace.

4. A method of incinerating a waste material, having the steps of combusting a portion of the waste material placed in a gasification furnace having an interior space substantially isolated from an exterior space and subjecting the other portion of the waste material to dry distillation with heat produced by the combustion of the portion of the waste material, and introducing a combustible gas generated by the dry distillation into a combustion furnace disposed outside said gasification furnace and combusting the combustible gas in the combustion furnace, wherein oxygen required to combust the combustible gas introduced into said combustion furnace is supplied depending on the amount of the combustible gas into the combustion furnace to combust the combustible gas, and the amount of oxygen supplied to said gasification furnace is controlled depending on a change in the temperature in the combustion furnace such that the temperature in the combustion furnace is kept at a predetermined temperature, for thereby adjusting the amount of the combustible gas generated by the dry distillation, said method being characterized in that, said gasification furnace comprises an air-cooled gasification furnace, said method being characterized by the steps of:

supplying combustive oxygen heated by a heat exchange with waste gases from said combustion furnace, to cool said gasification furnace;

performing a heat exchange between the combustive oxygen supplied to cool said gasification furnace and the waste gases from said combustion furnace, and supplying the heated combustive oxygen to said gasification furnace and/or said combustion furnace, said predetermined temperature being set to a temperature at which incineration residues produced when the waste material is incinerated are meltable;

charging said incineration residues into the combustion furnace from an incineration residue charging port thereof to melt the incineration residues with the heat generated when the combustible gas is combusted, while the combustible gas is being combusted in said combustion furnace, and discharging a melted material converted from the incineration residues out of the combustion furnace from a melted material outlet thereof and cooling the melted material into a solid material; and heating the combustion furnace to keep the temperature near said melted material outlet at said predetermined temperature with a heating means provided on said combustion furnace near said melted material outlet after said combustible gas starts to be combusted in said combustion furnace, further characterized in that said incineration residues are gradually charged into said combustion furnace after the temperature in said combustion furnace rises to a temperature close to said predetermined temperature after the dry distillation of said waste material is started in said gasification furnace.

5. A method of incinerating a waste material, having the steps of combusting a portion of the waste material placed in a gasification furnace having an interior space substantially isolated from an exterior space and subjecting the other portion of the waste material to dry distillation with heat produced by the combustion of the portion of the waste material, and introducing a combustible gas generated by the dry distillation into a combustion furnace disposed outside said gasification furnace and combusting the combustible gas in the combustion furnace, wherein oxygen required to combust the combustible gas introduced into said combustion furnace is supplied depending on the amount of the combustible gas into the combustion furnace to combust the combustible gas, and the amount of oxygen supplied to said gasification furnace is controlled depending on a change in the temperature in the combustion furnace such that the temperature in the combustion furnace is kept at a predetermined temperature, for thereby adjusting the amount of the combustible gas generated by the dry distillation, said method being characterized in that, said gasification furnace comprises an air-cooled gasification furnace, said method being characterized by the steps of:

supplying combustive oxygen heated by a heat exchange with waste gases from said combustion furnace, to cool said gasification furnace;

performing a heat exchange between the combustive oxygen supplied to cool said gasification furnace and the waste gases from said combustion furnace, and supplying the heated combustive oxygen to said gasification furnace and/or said combustion furnace, said predetermined temperature being set to a temperature at which incineration residues produced when the waste material is incinerated are meltable; and charging said incineration residues into the combustion furnace from an incineration residue charging port thereof to melt the incineration residues with the heat generated when the combustible gas is combusted, while the combustible gas is being combusted in said combustion furnace, and discharging a melted material converted from the incineration residues out of the combustion furnace from a melted material outlet thereof and cooling the melted material into a solid material, further characterized in that said combustive oxygen, which has been supplied to cool said gasification furnace, is supplied from an air jacket of said gasification furnace and through an air blower fan to a heat exchanger disposed in said combustion furnace, wherein after having undergone heat exchange in said heat exchanger, the heated combustive oxygen is supplied to at least one of said gasification furnace and said combustion furnace as well as being recirculated again to said air jacket.

* * * * *